United States Patent [19]

Brown et al.

[11] Patent Number: 4,917,383

[45] Date of Patent: Apr. 17, 1990

[54] ACTION TARGET

[75] Inventors: Robert L. Brown, Lakeview; Robert D. Shilen, Tonawanda; Robert F. Rosnak, Depew, all of N.Y.

[73] Assignee: The Quaker Oats Company, Chicago, Ill.

[21] Appl. No.: 421,776

[22] Filed: Oct. 16, 1989

[51] Int. Cl.[4] ..... A63F 7/00; A63F 9/16

[52] U.S. Cl. ..... 273/118 R; 273/108

[58] Field of Search ..... 273/108, 118 R, 118 D, 273/127 R, 127 D

[56] References Cited

U.S. PATENT DOCUMENTS 1,430,838 11/1922 Olson ..... 273/118 R
3,158,378 11/1964 Hastings ..... 273/118 R
3,756,603 9/1973 Goldfarb et al. ..... 273/108
4,039,190 8/1977 Kachaylo ..... 273/108
4,058,315 11/1977 Guise, Jr. ..... 273/118 R

*Primary Examiner*—Edward M. Coven
*Assistant Examiner*—Gary Jackson
*Attorney, Agent, or Firm*—Cumpston & Shaw

[57] ABSTRACT

An action target for a marble game includes a base supportable on a playing surface, for dividing the playing surface into two playing areas, a movable arm pivotally mounted to the base and swingable between positions in each of the two playing areas, a target on the arm extending laterally therefrom into each of the two playing areas when the arm is aligned with the base, and an indicator responsive to movement of the arm past a preselected point in each of the two playing areas for signalling a victory by one player.

12 Claims, 4 Drawing Sheets

ACTION TARGET

This invention relates in general to marble games, and more particularly to an action target for a marble game.

There is a continuing need for new and interesting toys. Children particularly enjoy playing competitive games, and games in which projectiles may be aimed at targets. Such games are beneficial in that they utilize and possibly improve eye-hand coordination. Games such as air hockey in which two players bounce an object off resilient cushions are very popular, but require expensive equipment, and are often found only in taverns where young children may not be welcome.

Accordingly, it is an object of this invention to provide a new and interesting action target and a game employing the target. It is a more particular object of this invention to provide an action target for a marble game that includes a base supportable on a playing surface, for dividing the playing surface into two playing areas, a movable arm pivotally mounted to the base and swingable between positions in each of the two playing areas, a target on the arm extending laterally therefrom into each of the two playing areas when the arm is aligned with the base, and an indicator responsive to movement of the arm past a preselected point in each of the two playing areas for signaling a victory by one player.

It is a further object of this invention to provide an action target as described above, having a rotating target attached to a movable arm, the target adapted to spin when struck by a marble.

It is a still further object of this invention to provide an action target having a flag indicator that is normally held in a retracted position in the base, by a hub to which the arm is attached, which is released through notches angularly spaced apart on the hub when the arm moves to one or the other of the two playing areas.

It is a still further object of this invention to provide an action game utilizing a target as described above, and including a playing surface along which a marble may be rolled, and which supports the action target, and at least one resilient bumper bordering the playing surface opposite the action target, for deflecting marbles that strike the bumper, back towards the target.

While the novel aspects of the invention are set forth with particularity in the accompanying claim, the invention itself, together with further objects and advantages thereof, may be more readily appreciated by reference to the following detailed description of a presently preferred embodiment of the invention taken in conjunction with the accompanying drawings in which:

Figure 1:
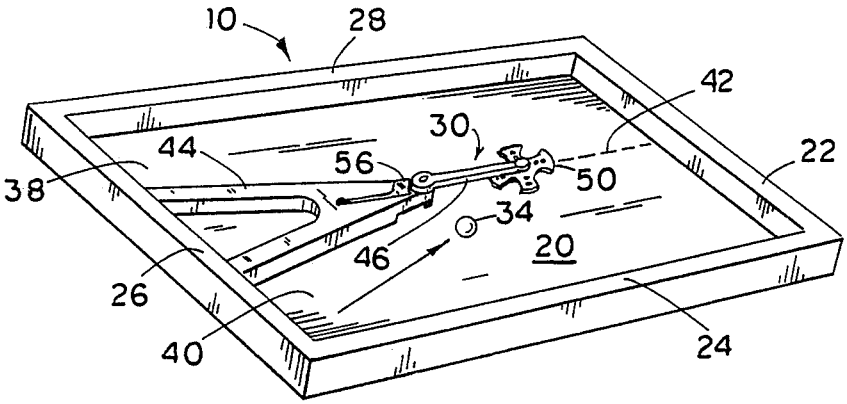
FIG. 1 is a perspective view of a game including an action target in accordance with the invention, showing the action target in a centered configuration.

Referring now to FIG. 1, an action game indicated generally at 10 includes a generally flat playing surface 20, surrounded on four sides by resilient bumpers 22, 24, 26, and 28. While the arrangement of playing surfaces and bumpers shown in FIG. 1 is rectangular, those skilled in the art will recognize that other shapes may also be used. An action target indicated generally at 30 is supported on base 20, and is adapted to be struck by marbles, such as marble 34, launched by players from two playing areas 38 and 40, disposed on opposite sides of dotted line 42. While only a single marble 34 is shown in FIG. 1, it will be understood that two players will simultaneously or alternately launch marbles from positions adjacent bumper 26 toward target 30 during the course of the game.

Target 30 includes a generally triangular base 44 supported by playing surface 20, and positioned adjacent bumper 26. A movable arm 46 is pivotally attached to one end of base 44 for rotational movement between playing areas 38 and 40. A decorative target 50 is rotatably attached to one end of arm 46 and includes portions that extend laterally outwardly from the arm into the two playing areas when the arm 46 is generally aligned with the base and lies on the center line dividing the two playing areas.

Figure 2:
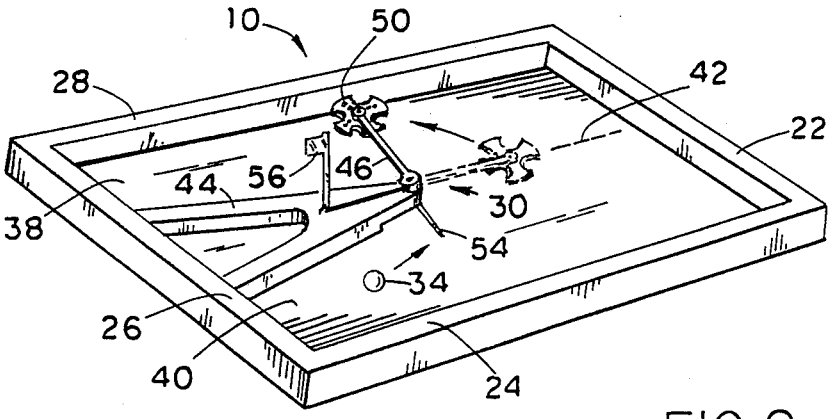
FIG. 2 is a perspective view of the game of FIG. 1 showing the action target displaced into one playing area with the indicator flag raised to signal a victory by one player.

As shown in FIG. 2, when the player shooting from side 40 is successful in striking arm 46 and/or target 50 and displacing arm 46 sufficiently far into playing area 38, an indicator flag 56 is automatically released from a position stored within base 44 and pops up to a raised position indicating a victory. Because rotating target 50 may be impossible to hit by a direct shot once it has been displaced some distance from its center position, a preferred embodiment of this invention includes an auxiliary arm 54 attached to the end of arm 46 that is attached to base 44, to provide a secondary target that may be struck to displace arm 46 the necessary distance to score a win.

Figure 3:
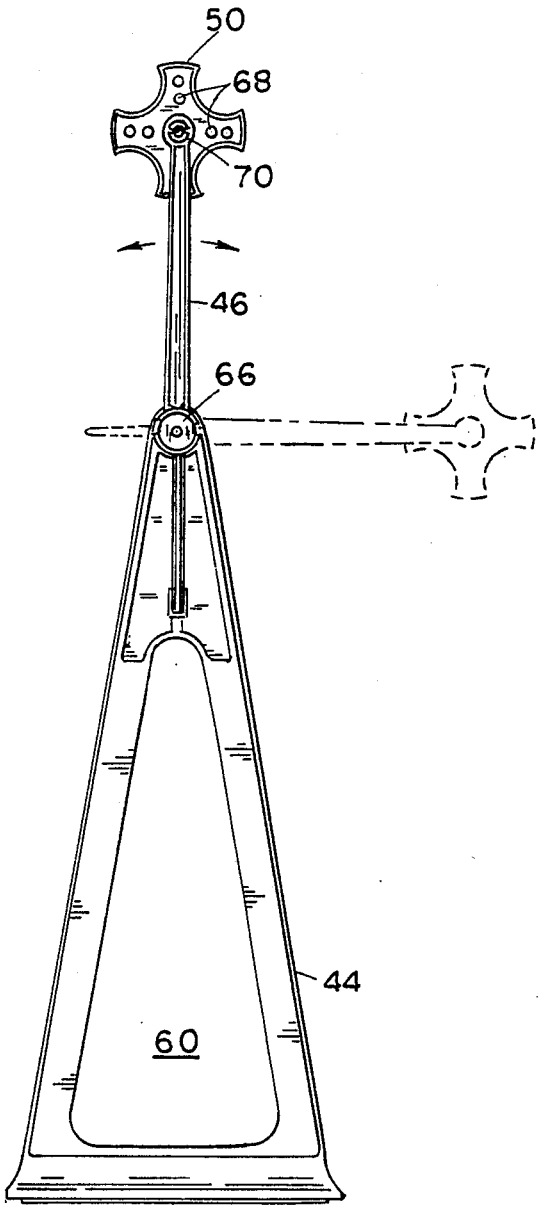
FIG. 3 is a top plan view of an action target in accordance with this invention.
Figure 4:
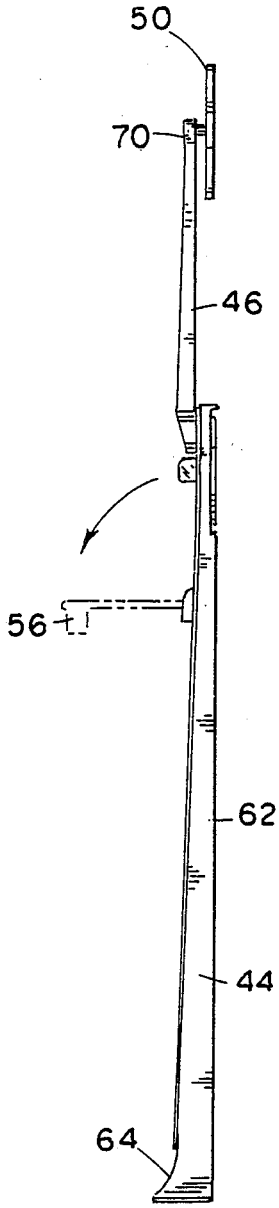
FIG. 4 is a side elevation thereof.
Figure 5:
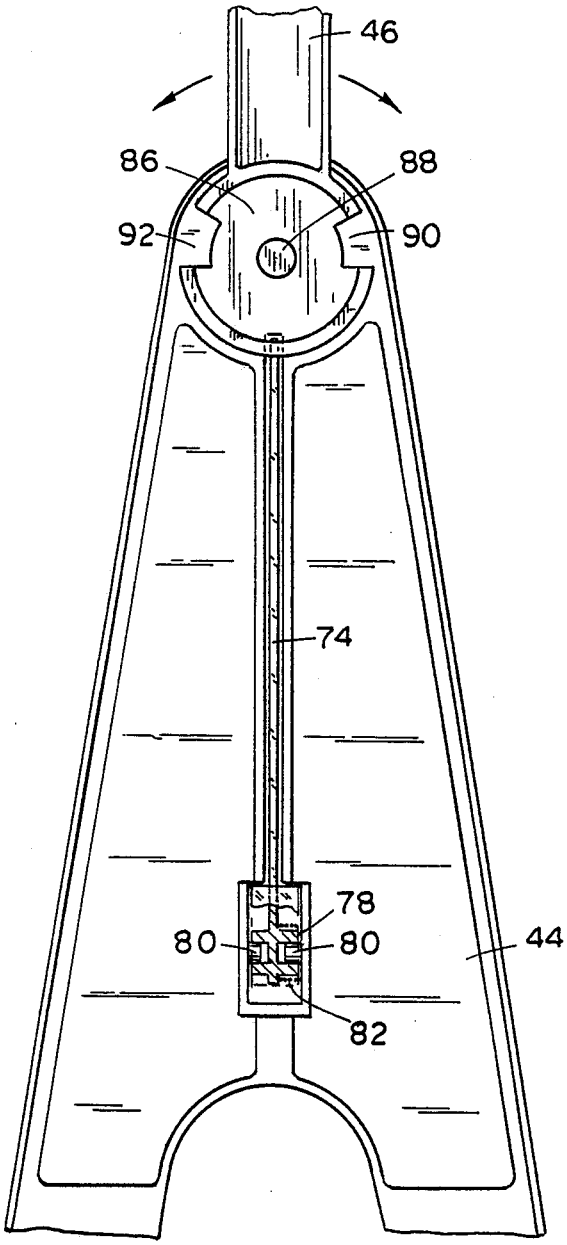
FIG. 5 is an enlarged segmental top plan view of the action target of this invention, particularly showing the indicator flag portion thereof.
Figure 6:
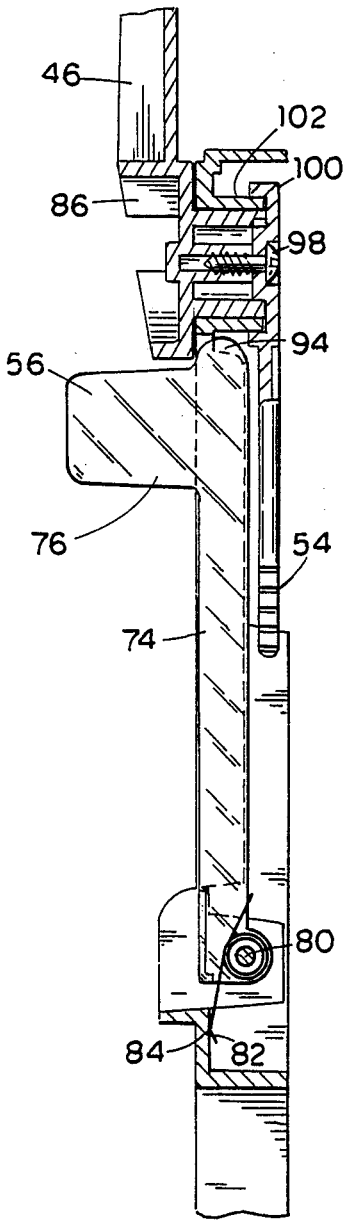
FIG. 6 is a side elevation of the portion of the invention shown in FIG. 5.

The structure of the action target itself may be more fully appreciated by referring now to FIGS. 3 and 4. Base 44 is generally triangular, as seen in plan view, and has a triangular central opening 60. Base 44 and the other elements of the invention may be fabricated in a multiplicity of ways from a variety of materials, and molded plastic parts are advantageously used. Base 44 has a substantially flat bottom surface 62, and an attractively curved upper surface 64. Movable arm 46 is attached to base 44, at a pivot point 66, and is adapted to swing fully back and forth as indicated by the arrows in FIG. 3. Rotatable target 50, which is preferably symmetrically shaped in the manner of a Greek cross, and which even more preferably has four identical arms, each characterized by generally concave edges as shown, is rotatably attached to the other end of arm 46. A plurality of holes 68 is preferably provided to enhance the appearance of target 50, and to improve the manufacturability thereof.

Preferably, as can be seen in FIG. 4, arm 46 is suspended over the playing surface for free swinging movement with respect thereto, and target 50 is likewise suspended over the surface from arm 46 at a pivot point 70. Thus, when a marble strikes one of the arms of target 50, the target spins and imparts a rotational force to arm 46, to deflect it in one direction or the other, depending on the side from which the target is struck. Movement of arm 46 and target 50 to one side is illustrated in phantom in FIG. 3. As will be more fully described in connection with FIGS. 5 through 8, when arm 46 is displaced a predetermined distance to one side or the other, flag 56 pops up from base 44 to indicate a victory by one player.

Referring now to FIGS. 5 through 8, the operation of flag 5 may be more readily appreciated. Flag 56 which is preferably molded as a single piece includes a mast portion 74 with a pennant portion 76 formed at one end, and a bearing portion 78 at the opposite end. Bearing 78 includes a generally cylindrical member having two axially aligned blind bores that engage stub shafts 80 formed in base 44 for pivotally mounting flag 56 therein. Preferably, a torsion spring 82 is disposed around the cylindrical member, and engages a flange 84 on base 44 with one arm, and mast 74 with the other as most clearly seen in FIG. 6 for continuously urging flag 56 to an upright position.

Figure 7:
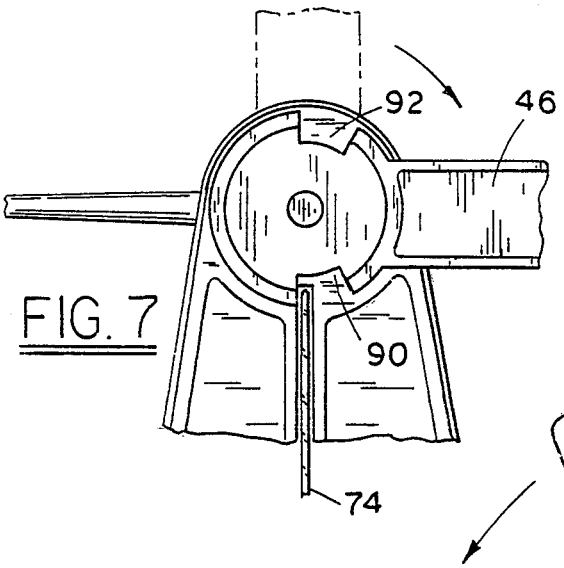
FIG. 7 is a segmental top plan view of the invention showing the flag release mechanism in more detail.
Figure 8:
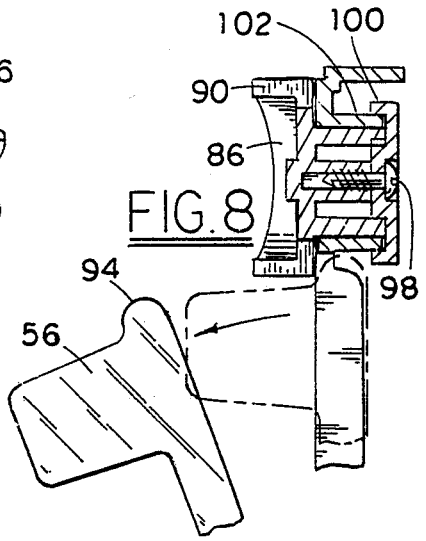
FIG. 8 is a side elevation of the portion of the invention shown in FIG. 7.

One end of movable arm 46 is provided with a generally cylindrical hub 86 that is pivotally mounted to a post 88 on base 44. Hub 86 includes first and second angularly spaced apart notches 90 and 92, formed in the periphery thereof, one of which notches is aligned with a tab 94 of flag 56 when arm 46 is rotated past a predetermined position on one or the other sides of the playing field. As will be readily appreciated, when one of notches 90, 92 is aligned with tab 94, flag 56 is popped quickly to an upright position by spring 82, as shown in FIGS. 7 and 8.

Preferably, an auxiliary arm 54 is attached to hub 86 of arm 46 by a screw 98 or similar fastener. In accordance with a preferred embodiment of this invention, auxiliary arm 54 includes a hub 100, which when attached to hub 86 of arm 46 forms a bearing assembly with a cylindrical portion 102 of base 44, as most clearly seen in FIGS. 6 and 8.

Figure 9:
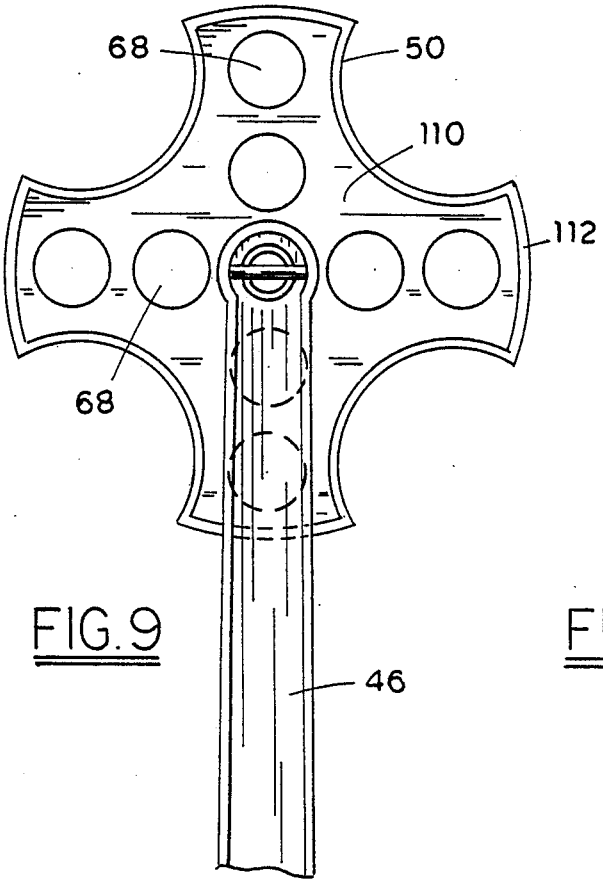
FIG. 9 is an enlarged segmental plan view of the rotating target portion of the invention.
Figure 10:
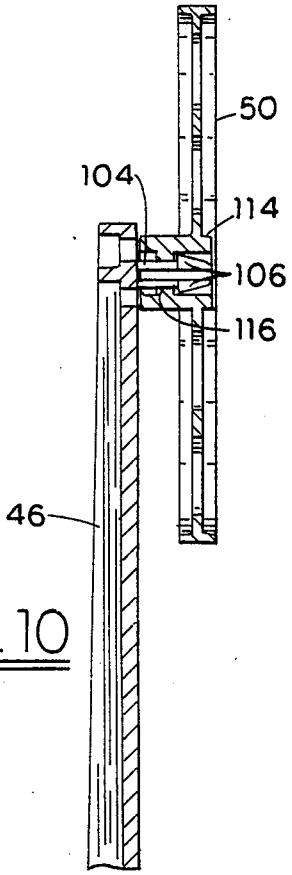
FIG. 10 is a side elevation thereof.

The construction of target 50 and the manner in which it is attached to arm 46 are illustrated in more detail in FIGS. 9 and 10. Preferably, arm 46 includes a downwardly extending resilient split mounting post 104 having locking barbs 106 at one end thereof. Target 50 preferably comprises a generally flat body portion 110 having a peripheral skirt 112 which provides a larger vertical target for the marbles. A central, hub 114 has an axial bore 116 therethrough for engaging locking barbs 106 for rotatably securing target 50 to arm 46.

While the invention has been described in connection with a presently preferred embodiment thereof, those skilled in the art will recognize that many modifications and changes may be made therein without departing from the true spirit and scope of the invention, which accordingly is intended to be defined solely by the appended claims.

What is claimed is:

1. An action target for a marble game comprising:

base means supportable on a playing surface for at least partially dividing the playing surface into two playing areas;

movable arm means pivotally mounted to the base means and swingable between positions in each of said two playing areas;

target means on said arm extending laterally therefrom into each of said two playing areas when the arm is aligned with the base means;

indicator means responsive to movement of said arm means past a preselected point in each of said two playing areas for signaling a victory by one player.

2. The action target of claim 1 in which the target means comprises target means rotatably attached to the movable arm and adapted to spin when struck by a marble.

3. The action target of claim 2 wherein said target means comprises a Greek cross.

4. The action target of claim 3 wherein the cross is pivotally mounted to the arm at the center of the cross.

5. The action target of claim 4 wherein the cross comprises four arms having concave sides.

6. The action target of claim 1 in which the indicator means is mounted on the base.

7. The action target of claim 6 in which the indicator means comprises a flag pivotally mounted on the base and spring biased to an upright position.

8. The action target of claim 7 in which the flag is held in a retracted position by ,said movable arm when the arm is generally aligned with the base and is released when the arm is rotated past a preselected point in either direction.

9. The action target of claim 8 in which the movable arm means comprises a hub rotatably mounted on the base and having first and second angularly spaced apart notches, and the flag comprises a tab projecting into engagement with the hub when the arm is generally aligned with the base and adapted to be released through one of the first and second notches when the arm is rotated past preselected point in each playing area.

10. The action target of claim 9 comprising spring means connected between the flag and the base for biasing the flag to an upright position.

11. The action target of claim 1 further comprising an auxiliary arm pivotally mounted to the base in alignment with the movable arm but extending in the opposite direction from the pivot whereby upon rotation of the movable arm from a position aligned with the base, one of the movable arm and the auxiliary arm extends into each of the two playing areas.

12. An action game comprise an action target as set forth in any of claims 1–11, and further comprising:

a playing surface on which said action target is supported; and at least one resilient bumper bordering said playing surface whereby marbles may directly strike the target or ricochet from the bumper.

* * * * *